US006679493B1

(12) United States Patent
Stephenson

(10) Patent No.: US 6,679,493 B1
(45) Date of Patent: Jan. 20, 2004

(54) FOLDING PUZZLE

(75) Inventor: Chad Stephenson, Newark, OH (US)

(73) Assignee: Cyril-Scott Company, Lancaster, OH (US)

( * ) Notice: Subject to any disclaimer, the term of this patent is extended or adjusted under 35 U.S.C. 154(b) by 0 days.

(21) Appl. No.: 10/320,848

(22) Filed: Dec. 16, 2002

(51) Int. Cl.[7] ..... A63F 9/08
(52) U.S. Cl. ..... 273/155
(58) Field of Search ..... 273/155, 153 R, 273/157 R

(56) References Cited

U.S. PATENT DOCUMENTS

| | | | | | |
|---|---|---|---|---|---|
| 2,327,875 | A | | 8/1943 | Edborg | |
| 2,655,382 | A | | 10/1953 | Belsky | |
| 3,267,597 | A | | 8/1966 | Jannes | |
| 3,962,816 | A | * | 6/1976 | Sarid | 273/155 |
| 4,170,355 | A | | 10/1979 | Finkin | |
| 4,429,878 | A | * | 2/1984 | Asao | 273/155 |
| 5,445,380 | A | | 8/1995 | Polsky | |
| 5,651,715 | A | * | 7/1997 | Shedelbower | 273/155 |
| 5,735,520 | A | | 4/1998 | Matos | |
| 6,523,826 | B1 | * | 2/2003 | Matos | 273/155 |

* cited by examiner

*Primary Examiner*—Steven Wong
(74) *Attorney, Agent, or Firm*—Gallagher & Dawsey Co. LPA; Michael J. Gallagher; David J. Dawsey

(57) ABSTRACT

A fold-through puzzle designed to interact and engage the interest of a puzzle solver for amusement and as a vehicle to present advertising to the viewer. The puzzle utilizes at east one planar member and a plurality of fold lines and may be repeatedly folded to create the illusion that several pieces of paper are being endlessly passed through themselves. In one embodiment, a plurality of planar members are attached to one another such that the members may pivot about each other on fold lines. In an alternative embodiment, the fold-through puzzle is configured with a single planar member and a plurality of incisions through the planar member, such that the puzzle maybe folded along fold lines, creating pivot areas and corner area, that when folded, produce the illusion that a single piece of paper is being endlessly passed through itself.

10 Claims, 10 Drawing Sheets

FOLDING PUZZLE

TECHNICAL FIELD

The present invention relates to the field of folding puzzles; particularly, to folding puzzles that are useful for advertising and are interactive.

BACKGROUND OF THE INVENTION

Advertisers have long-recognized the need for advertisements that are interactive and capture the target audience's attention. Such long-felt needs have been particularly prevalent in advertisements that are often discarded as "junk mail." It has long been recognized that puzzles often capture the full attention and concentration of their solvers, yet advertisers have been slow to adopt puzzles as an advertising medium.

Numerous prior art devices have recognized the demand for creative sectional and folding picture puzzles games. Sectional picture puzzles typically consist of a plurality of cards that when joined together in a particular fashion form a larger image. Folding picture puzzles generally form an image, or series of images, when the puzzle is folded along a series of predetermined lines.

Folding picture puzzles are exemplified by U.S. Pat. No. 2,327,875 to Edborg, U.S. Pat. No. 2,655,382 to Belsky, U.S. Pat. No. 3,267,597 to Jannes, U.S. Pat. No. 4,170,355 to Finkin, U.S. Pat. No. 5,445,380 to Polsky, and U.S. Pat. No. 5,735,520 to Matos. The '875, '382, '597, '355, and '380 can generally be classified as non-fold-through puzzles. A fold-through puzzle is one in which an aperture is formed through which the remaining portion of the puzzle is ultimately passed once folded or oriented correctly.

Non-fold-through puzzles, while they can be clever, all suffer from the same serious drawback: Their mode of operation is obvious even to the most casual observer. They rely on simple over-folding to bring apparently incongruous features into proximity to produce a clever result. A typical example is that of the '875 patent, where over-folding allows the puzzle worker to create four animals' heads.

Fold-through puzzles operate on a different principle. The casual observer of this type of puzzle is immediately struck by an apparent paradox. Intuitively believing that it is physically impossible to pass part of a piece of paper through itself over and over again, the puzzle worker finds himself or herself drawn into repeating the puzzle over and over again in search of discovering the "trick." The puzzle solver finds in remarkable not to have to, at some point, unfold the puzzle in a reverse direction. The simpler the puzzle appears, the more baffled the puzzle solver becomes, and as a result, the more intrigued with the puzzle and more inclined to continue laboring over it. Simplicity begets attention, making a simple fold-through puzzle an ideal advertising medium, as it is difficult to put down.

The '520 patent discloses a fold-through puzzle. The apertures of the various embodiments disclosed in the '520 patent are all created from a plurality of incisions interior to the puzzle periphery. However, the folding patterns required by the various '520 embodiments are rather cumbersome and complex, therefore not desirable for a number of applications wherein the ultimate goal is to capture the users attention for a period, perhaps for as little as a few seconds, while ensuring that the user does not become frustrated with the complexity of the device.

Accordingly, the art has needed a means for improving the art of fold-through picture puzzles. While some of the prior art devices attempted to improve the state of the art of fold-through puzzles, none has achieved the unique and novel configurations and capabilities of the present invention. With these capabilities taken into consideration, the instant invention addresses many of the shortcomings of the prior art and offers significant benefits heretofore unavailable. Further, none of the above inventions and patents, taken either singly or in combination, is seen to describe the instant invention as claimed.

SUMMARY OF INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations. An object of this invention is to provide an advertising medium in the form of a fold-through puzzle that is both clever and amusing and that engages the puzzle solver long enough for the solver to be adequately exposed to an advertising message. An additional object of the invention is to provide an amusing puzzle, with no advertising or other message on the puzzle.

The fold-through puzzle of the instant invention enables a significant advance in the state of the art. The preferred embodiments of the apparatus accomplish this by new and novel arrangements of elements that are configured in unique and novel ways and which demonstrate previously unavailable but preferred and desirable capabilities.

The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention. The fold-through puzzle of the instant invention includes at least one planar member and a plurality of fold lines, such that the puzzle may be manipulated to create the illusion that paper is being endlessly passed through itself. In one of the many preferable configurations, the fold-through puzzle incorporates, among other elements, at least one planar member.

In one of the many preferable embodiments, the fold-through puzzle incorporates, among other elements, a first planar member, a second planar member, a third planar member, and a fourth planar member. In this embodiment, the puzzle includes a plurality of planar members as follows. There is a first planar member having a first surface, a second surface, a first fold line, and a second fold line. There is a second planar member, substantially coplanar with the first planar member, having a first surface, a second surface, a first fold line, and a second fold line. Similarly, there is a third planar member having a first surface, a second surface, a first fold line, and a second fold line, wherein the first planar member second surface and the third planar member second surface are joined in part at a first joining location and the second planar member second surface and the third planar member second surface are joined in part at a second joining location.

There is a fourth planar member, substantially coplanar with the third planar member, having a first surface, a second surface, a first fold line, and a second fold line wherein the first planar member second surface and the fourth planar member second surface are joined in part at a third joining location and the second planar member second surface and the fourth planar member second surface are joined in part at a fourth joining location.

The fold-through puzzle may be configured such that the first joining location joins a third planar member first joining area and a first planar member first joining area. The second joining location may join a third planar member second joining area and a second planar member first joining area. The third joining location may join a fourth planar member first joining area and a first planar member second joining area. The fourth joining location may join a fourth planar member second joining area and a second planar member second joining area.

The arrangement of the planar members is such that the first planar member may pivot about the first fold line of the third planar member and the first fold line of the fourth planar member. The second planar member may pivot about the second fold line of the third planar member and the second fold line of the fourth planar member. The third planar member may pivot about the second fold line of the first planar member and the second fold line of the second planar member. The fourth planar member may pivot about the first fold line of the first planar member and the first fold line of the second planar member.

The fold-through puzzle may be configured such that the first planar member is substantially rectangular and formed with a first edge, a second edge, a third edge, and a fourth edge. In such configuration, the second planar member may be substantially rectangular and formed with a first edge, a second edge, a third edge, and a fourth edge. Similarly, the third planar member may be substantially rectangular and formed with a first edge, a second edge, a third edge, and a fourth edge; and the fourth planar member may be substantially rectangular and formed with a first edge, a second edge, a third edge, and a fourth edge.

In terms of relationships between the planar members, the fold-through puzzle may be configured such that the first planar member first fold line and the first planar member second fold line are substantially parallel to the first planar member second edge. In one particular embodiment, the first fold line may be located approximately one quarter of the length of the first planar member first edge away from the second edge and the second fold line may be located approximately three quarters of the length of the first planar member first edge away from the second edge.

Similarly, the second planar member first fold line and the second planar member second fold line may be substantially parallel to the second planar member second edge. The first fold line may be located approximately one quarter of the length of the second planar member first edge away from the second edge and the second fold line may be located approximately three quarters of the length of the first planar member first edge away from the second edge. Thirdly, the third planar member first fold line and the third planar member second fold line may be substantially parallel to the third planar member second edge. The first fold line may be located approximately one quarter of the length of the third planar member first edge away from the second edge and second fold line may be located approximately three quarters of the length of the third planar member first edge away from the second edge.

Lastly, the fourth planar member first fold line and the fourth planar member second fold line may be substantially parallel to the fourth planar member second edge. The first fold line may be located approximately one quarter of the length of the fourth planar member first edge away from the second edge and second fold line may be located approximately three quarters of the length of the fourth planar member first edge away from the second edge.

Joining may be by means of adhesives, mechanical fasteners, or such other joining methods as would be understood feasible by one skilled in the art.

Additionally, the fold-through puzzle may be configured such that the third planar member first joining area is bounded by the third planar member first edge, the third planar member second edge, the third planar member first fold line, and an imaginary line extending from substantially the midpoint of third planar member first fold line to substantially the midpoint of the third planar member second edge. The cooperating first planar member first joining area is bounded by the first planar member first edge, the first planar member fourth edge, the first planar member second fold line, and an imaginary line extending from substantially the midpoint of first planar member second fold line to substantially the midpoint of the first planar member fourth edge.

Similarly, the third planar member second joining area is bounded by the third planar member first edge, the third planar member fourth edge, the third planar member second fold line, and an imaginary line extending from substantially the midpoint of third planar member second fold line to substantially the midpoint of the third planar member fourth edge. The cooperating second planar member first joining area may be located on the second planar member second surface and is bounded by the second planar member first edge, the second planar member fourth edge, the second planar member second fold line, and an imaginary line extending from substantially the midpoint of second planar member second fold line to substantially the midpoint of the second planar member fourth edge.

Additionally, the fourth planar member first joining area is bounded by the fourth planar member first edge, the fourth planar member fourth edge, the fourth planar member first fold line, and an imaginary line extending from substantially the midpoint of the fourth planar member first fold line to substantially the midpoint of the fourth planar member fourth edge. The cooperating first planar member second joining area is located on the first planar member second surface and is bounded by the first planar member first edge, the first planar member second edge, the first planar member first fold line, and an imaginary line extending from substantially the midpoint of first planar member first fold line to substantially the midpoint of the first planar member fourth edge.

Lastly, the fourth planar member second joining area is bounded by the fourth planar member first edge, the fourth planar member second edge, the fourth planar member second fold line, and an imaginary line extending from substantially the midpoint of fourth planar member second fold line to substantially the midpoint of the fourth planar member second edge. The cooperating second planar member second joining area is located on the second planar member second surface and is bounded by the second planar member first edge, the second planar member second edge, the second planar member first fold line, and an imaginary line extending from substantially the midpoint of second planar member first fold line to substantially the midpoint of the second planar member second edge.

As the mechanism of the puzzle illusion is the creation of an apparently endless numbers of pass-throughs, it will be apparent to one skilled in the art that the manipulation of the puzzle may be begun in many possible orientations. By way of example and not limitation, the puzzle may be successfully manipulated in the following steps, with folding directions given in relation to the puzzle solver facing the puzzle.

The puzzle may be held in front of the puzzle solver with the first planar member and the second planar member oriented vertically with the first planar member first surface oriented towards the solver and on the solver's left side and the second planar member first surface oriented towards the solver and on the solver's right side. The first planar member may then be rotated to the left and outwardly, around a rotational line connecting the third planar member first fold line and the fourth planar member first fold line. This maneuver exposes the outer aspect of the first planar member second surface, the left lateral aspect of the third planar member second surface, and the left lateral aspect of the fourth planar member. The second planar member may then be rotated to the right and outwardly, around a rotational line connecting the third planar member second fold line and the fourth planar member second fold line. This maneuver exposes the outer aspect of the second planar member second surface, the right lateral aspect of the third planar member second surface, and the right lateral aspect of the fourth planar member.

Next, the fourth planar member may be rotated upwards and outwardly, around a rotational line connecting the first planar member first fold line and the second planar member first fold line. This exposes a portion of the fourth planar member second surface, an additional portion of the first planar member second surface, and an additional portion of the second planar member second surface. Next, the third planar member may be rotated downwards and outwardly around a rotational line connecting the first planar member second fold line and the second planar member second fold line. This exposes a portion of the third planar member second surface, an additional portion of the first planar member second surface, and an additional portion of the second planar member second surface.

The puzzle solution continues by rotating the left lateral aspect of the third planar member and the left lateral aspect of the fourth planar member about a rotational line connecting the third planar member first fold line and the fourth planar member first fold line, and by rotating the right lateral aspect of the third planar member and the right lateral aspect of the fourth planar member about a rotational line connecting the third planar member second fold line and the fourth planar member second fold line. This exposes the full surface of the third planar member first surface and the full surface of the fourth planar member first surface.

The puzzle solution may then be completed by rotating the third planar member downwards and outwardly about a rotational line connecting first planar member second fold line and the second planar member second fold line, and by rotating the fourth planar member upwards and outwardly around a rotational line connecting the first planar member first fold line and the second planar member first fold line. This returns the puzzle to its original configuration, completing the puzzle and fostering the illusion that the paper has been passed through itself. The process may be repeated a countless number of time, with each repetition serving to further engage the puzzle solver in deciphering the illusion.

In another one of the many preferable embodiments, the fold-through puzzle may be constructed from a single, incised, planar member. Such a configuration, because it uses a single planar member, increases the illusion that the puzzle accomplishes an impossible task.

In such configuration, the fold-through puzzle includes a single sheet base having a planar member with a defined center point. Such an embodiment further comprises a first corner, a second corner, a third corner, and a fourth corner. Such configuration results in a first edge connecting the fourth and first corners, a second edge connecting the first and second corners, a third edge connecting the second and third corners, and a fourth edge connecting the third and fourth corners. The planar member has a first surface and a second surface. The operation of such an embodiment is best understood by first identifying a number of points on the surface of the puzzle.

The sheet base may include a center point of the planar member, a first primary midpoint at the midpoint of the first edge, a second primary midpoint at the midpoint of the second edge, a third primary midpoint at the midpoint of the third edge, and a fourth primary midpoint at the midpoint of the fourth edge.

There may be a first secondary midpoint at the point along the first edge at the midpoint between the fourth corner and the first primary midpoint and a second secondary midpoint at the point along the first edge at the midpoint between the first primary midpoint and the first corner. There may be a third secondary midpoint at the point along the second edge at the midpoint between the first corner and the second primary midpoint and a fourth secondary midpoint at the point along the second edge at the midpoint between the second primary midpoint and the second corner. There may be a fifth secondary midpoint at the point along the third edge at the midpoint between the second corner and the third primary midpoint and a sixth secondary midpoint at the point along the third edge at the midpoint between the third primary midpoint and the third corner. There may be a seventh secondary midpoint at the point along the fourth edge at the midpoint between the third corner and the fourth primary midpoint and an eighth secondary midpoint at the point along the fourth edge at the midpoint between the fourth primary midpoint and the fourth corner.

There is a first tertiary midpoint at the midpoint of a line connecting the first primary midpoint and the second primary midpoint, a second tertiary midpoint at the midpoint of a line connecting the second primary midpoint and the third primary midpoint, a third tertiary midpoint at the midpoint of a line connecting the third primary midpoint and the fourth primary midpoint, and a fourth tertiary midpoint at the midpoint between the fourth primary midpoint and the first primary midpoint.

Reference to the abovementioned points identifies at least one incision through the square planar member. There is a first incision through the square planar member connecting the fourth tertiary midpoint and the center point of the square planar member and a second incision through the square planar member connecting the first tertiary midpoint and the center point of the square planar member. There is a third incision through the square planar member connecting the second tertiary midpoint and the center point of the square planar member and a fourth incision through the square planar member connecting the third tertiary midpoint and the center point 999 of the square planar member.

Reference to the abovementioned points identifies fold and pivot lines, about which the puzzle is manipulated in order to give rise to the puzzle illusion. The single planar member displays a plurality of fold lines, such that there may be a first fold line connecting the second secondary midpoint and the first tertiary midpoint and a second fold line connecting the third secondary midpoint and the first tertiary midpoint. There may be a third fold line connecting the fourth secondary midpoint and the first tertiary midpoint and a fourth fold line connecting the fifth secondary midpoint and the second tertiary midpoint. There may be a fifth fold line connecting the sixth secondary midpoint and the third tertiary midpoint and a sixth fold line connecting the seventh secondary midpoint and the third tertiary midpoint. There may be a seventh fold line connecting the eighth secondary midpoint and the fourth tertiary midpoint and an eighth fold line connecting the first secondary midpoint and the fourth tertiary midpoint.

The single planar member displays a plurality of pivot areas, such that there is a first pivot area having a first side defined by the first edge, a second side defined by the second fold line, a third side defined by the second incision, a fourth side defined by the first incision, and a fifth side defined by the eighth fold line, the first pivot area additionally having a first surface and a second surface.

There is a second pivot area having a first side defined by the second fold line, a second side defined by the second edge, a third side defined by the third fold line, a fourth side defined by the third incision, and a fifth side defined by the third incision, the second pivot area additionally having a first surface and a second surface.

There is a third pivot area having a first side defined by the third edge, a second side defined by the fourth fold line, a third side defined by the third incision, a fourth side defined by the fourth incision, and a fifth side defined by the fifth fold line, the third pivot area additionally having a first surface and a second surface.

There is a fourth pivot area having a first side defined by the seventh fold line, a second side defined by the first incision, a third side defined by the fourth incision, a fourth side defined by the sixth fold line, and a fifth side defined by the fourth edge, the fourth pivot area additionally having a first surface and a second surface.

Reference to the abovementioned fold and pivot lines also identifies corner areas of the puzzle. The single planar sheet displays a plurality of corner areas such that there is a first corner area having a first side defined by the first edge, a second side defined by the second edge, a third side defined by the second fold line and a fourth side defined by the first fold line, the first corner area additionally having a first surface and a second surface.

Additionally, there is a second corner area having a first side defined by the third fold line, a second side defined by the second edge, a third side defined by the third edge, and a fourth side defined by the fourth fold line, the second corner area additionally having a first surface and a second surface.

Similarly, there is a third corner area having a first side defined by the sixth fold line, a second side defined by the fifth fold line, a third side defined by the third edge, and a fourth side defined by the fourth edge, the third corner area additionally having a first surface and a second surface.

Lastly, there is a fourth corner area having a first side defined by the first edge, a second side defined by the eighth fold line, a third side defined by the seventh fold line and a fourth side defined by the fourth edge, the fourth corner area additionally having a first surface and a second surface.

As the mechanism of the puzzle illusion is the creation of an apparently endless numbers of pass-throughs, it will be apparent to one skilled in the art that the manipulation of the puzzle may be begun in many possible orientations. By way of example and not limitation, the puzzle may be successfully manipulated in the following steps, with folding and pivoting directions given in relation to the puzzle solver facing the puzzle.

The puzzle solution may begin with the puzzle solver facing the planar member from the first planar member first surface. The first manipulation may be of pivoting the first pivot area backwards and upwards, by simultaneously folding the fourth corner area along the seventh fold line and the first corner area along the second fold line, such that the fourth corner area lies behind the fourth pivot area and the first corner area lies behind the second pivot area. Next, the puzzle solver pivots the third pivot area downwards by simultaneously folding the second corner area along the third fold line and the third corner area along the sixth fold line, such that the second corner area lies behind the second pivot area and the third corner area lies behind the fourth pivot area. This exposes a portion of the first pivot area second surface, the second pivot area first surface, a portion of the third pivot area second surface, and the fourth pivot area first surface.

The puzzle solver next pivots the fourth pivot area to the left and the second pivot area to the right. This reveals all of the first pivot area second surface and the third pivot area second surface portion, as well as a portion of the fourth pivot area second surface and a portion of the second pivot area second surface.

The puzzle solver then pivots the first pivot area upwards and the third pivot area downwards, thus exposing the fourth corner area second surface, the first corner area second surface, the second pivot area second surface, the second corner area second surface, the third corner area second surface, and the fourth pivot area second surface. The puzzle is completed and returned to its original configuration by pivoting the fourth pivot area to the left and outwards by simultaneously folding the fourth corner area outwards and to the left, along the eighth fold line and the third corner area outwards and to the left along the fifth fold line; and then folding the second pivot area outwards and to the right by simultaneously folding the first corner area along the first fold line and the second corner area along the fourth fold line. This maneuver completes the puzzle and the illusion thereof and returns the puzzle to the opening configuration.

In the various embodiments, it is envisioned that the planar surface or surfaces of the puzzle will have generally cooperating sections of differing color, imagery or text; or some combination thereof; imprinted on them. The folding of the puzzle will cause a change in the relative positions of the cooperating sections so as to produce an arresting or amusing image to the puzzle viewer. Such cooperating sections may be formed with advertising indicia, such as text or imagery, or may be configured purely for the amusement of the viewer. Additionally, such cooperating segments may differ in the textural or other surface characteristics.

BRIEF DESCRIPTION OF THE DRAWINGS

Without limiting the scope of the present invention as claimed below and referring now to the drawings and figures:

Figure 1:
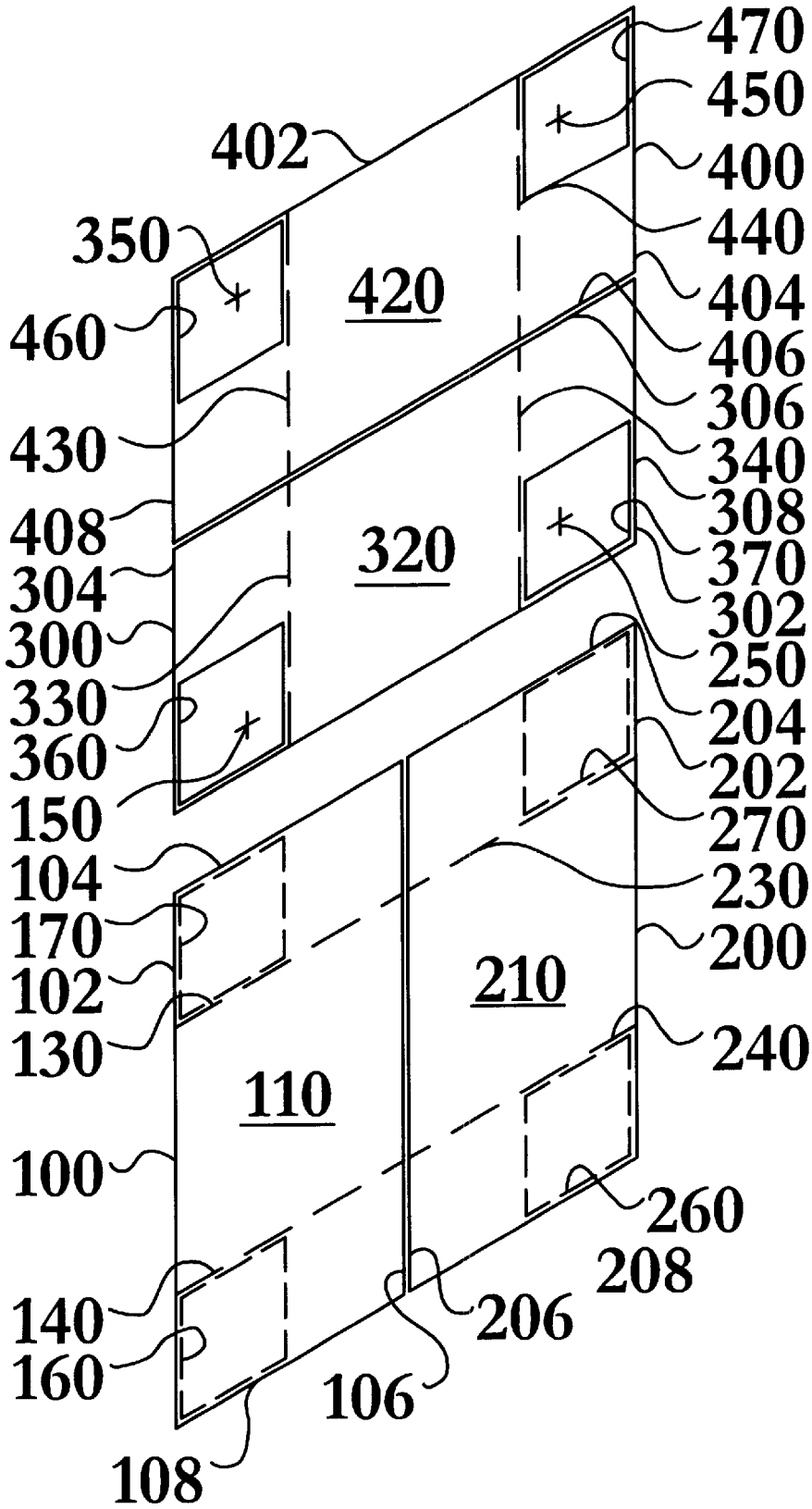
FIG. 1 shows a folding puzzle in elevated perspective view, in reduced scale.

Also, in the various figures and drawings, the following reference symbols and letters are used to identify the various elements described herein below in connection with the several figures and illustrations: R.

DETAILED DESCRIPTION OF THE INVENTION

The fold-through puzzle of the instant invention enables a significant advance in the state of the art. The preferred embodiments of the apparatus accomplish this by new and novel arrangements of elements that are configured in unique and novel ways and which demonstrate previously unavailable but preferred and desirable capabilities.

The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention. The fold-through puzzle of the instant invention includes at least one planar member and a plurality of fold lines, such that the puzzle may be manipulated to create the illusion that paper is being endlessly passed through itself. With reference generally to FIG. 1 through 15, in one of the many preferable configurations, the fold-through puzzle incorporates, among other elements, at least one planar member 100, 200, 300, 400, 500.

With reference specifically now to FIGS. 1 through 5, in one of the many preferable embodiments, the fold-through puzzle incorporates, among other elements, a first planar member 100, a second planar member 200, a third planar member 300, and a fourth planar member 400. In this embodiment, the puzzle includes a plurality of planar members as follows. There is a first planar member 100 having a first surface 110, a second surface 120, a first fold line 130, and a second fold line 140. There is a second planar member 200, substantially coplanar with the first planar member 100, having a first surface 210, a second surface 220, a first fold line 230, and a second fold line 240. Similarly, there is a third planar member 300 having a first surface 310, a second surface 320, a first fold line 330, and a second fold line 340, wherein the first planar member second surface 120 and the third planar member second surface 320 are joined in part at a first joining location 150 and the second planar member second surface 220 and the third planar member second surface 320 are joined in part at a second joining location 250. There is a fourth planar member 400, substantially coplanar with the third planar member 300, having a first surface 410, a second surface 420, a first fold line 430, and a second fold line 440 wherein the first planar member second surface 120 and the fourth planar member second surface 420 are joined in part at a third joining location 350 and the second planar member second surface 220 and the fourth planar member second surface 420 are joined in part at a fourth joining location 450.

The fold-through puzzle may be configured such that the first joining location 150 joins a third planar member first joining area 360 and a first planar member first joining area 160. The second joining location 250 may join a third planar member second joining area 370 and a second planar member first joining area 260. The third joining location 350 may join a fourth planar member first joining area 460 and a first planar member second joining area 170. The fourth joining location 450 may join a fourth planar member second joining area 470 and a second planar member second joining area 270.

Referring to FIG. 1, the arrangement of the planar members is such that the first planar member 100 may pivot about the first fold line 330 of the third planar member 300 and the first fold line 430 of the fourth planar member 400. The second planar member 200 may pivot about the second fold line 340 of the third planar member 300 and the second fold line 440 of the fourth planar member 400. The third planar member 300 may pivot about the second fold line 140 of the first planar member 100 and the second fold line 240 of the second planar member 200. The fourth planar member 400 may pivot about the first fold line 130 of the first planar member 100 and the first fold line 230 of the second planar member 200.

The fold-through puzzle may be configured such that the first planar member 100 is substantially rectangular and formed with a first edge 102, a second edge 104, a third edge 106, and a fourth edge 108. In such configuration, the second planar member 200 may be substantially rectangular and formed with a first edge 202, a second edge 204, a third edge 203, and a fourth edge 204. Similarly, the third planar member 300 may be substantially rectangular and formed with a first edge 302, a second edge 304, a third edge 306, and a fourth edge 308; and the fourth planar member 400 may be substantially rectangular and formed with a first edge 402, a second edge 404, a third edge 406, and a fourth edge 408.

In terms of relationships between the planar members 100, 200, 300, 400, the fold-through puzzle may be configured such that the first planar member first fold line 130 and the first planar member second fold line 140 are substantially parallel to the first planar member second edge 104. In one particular embodiment, the first fold line 130 may be located approximately one quarter of the length of the first planar member first edge 102 away from the second edge 104 and the second fold line 140 may be located approximately three quarters of the length of the first planar member first edge 102 away from the second edge 104.

Similarly, the second planar member first fold line 230 and the second planar member second fold line 240 may be substantially parallel to the second planar member second edge 204.

The first fold line 230 may be located approximately one quarter of the length of the second planar member first edge 202 away from the second edge 204 and the second fold line 240 may be located approximately three quarters of the length of the first planar member first edge 102 away from the second edge 204. Thirdly, the third planar member first fold line 330 and the third planar member second fold line 340 may be substantially parallel to the third planar member second edge 304. The first fold line 330 may be located approximately one quarter of the length of the third planar member first edge 302 away from the second edge 304 and second fold line 340 may be located approximately three quarters of the length of the third planar member first edge 302 away from the second edge 304.

Lastly, the fourth planar member first fold line 430 and the fourth planar member second fold line 440 may be substantially parallel to the fourth planar member second edge 404. The first fold line 430 may be located approximately one quarter of the length of the fourth planar member first edge 402 away from the second edge 404 and second fold line 440 may be located approximately three quarters of the length of the fourth planar member first edge 402 away from the second edge 404.

Joining may be by means of adhesives, mechanical fasteners, or such other joining methods as would be understood feasible by one skilled in the art.

Additionally, referring still to FIG. 1, the fold-through puzzle may be configured such that the third planar member first joining area 360 is bounded by the third planar member first edge 302, the third planar member second edge 304, the third planar member first fold line 330, and an imaginary line extending from substantially the midpoint of third planar member first fold line 330 to substantially the midpoint of the third planar member second edge 304. The cooperating first planar member first joining area 160 is bounded by the first planar member first edge 102, the first planar member fourth edge 108, the first planar member second fold line 140, and an imaginary line extending from substantially the midpoint of first planar member second fold line 140 to substantially the midpoint of the first planar member fourth edge 108.

Similarly, referring still to FIG. 1, the third planar member second joining area 370 is bounded by the third planar member first edge 302, the third planar member fourth edge 308, the third planar member second fold line 340, and an imaginary line extending from substantially the midpoint of third planar member second fold line 340 to substantially the midpoint of the third planar member fourth edge 308. The cooperating second planar member first joining area 260 may be located on the second planar member second surface 220 and is bounded by the second planar member first edge 202, the second planar member fourth edge 208, the second planar member second fold line 240, and an imaginary line extending from substantially the midpoint of second planar member second fold line 240 to substantially the midpoint of the second planar member fourth edge 208.

Additionally, still referring to FIG. 1, the fourth planar member first joining area 460 is bounded by the fourth planar member first edge 402, the fourth planar member fourth edge 408, the fourth planar member first fold line 430, and an imaginary line extending from substantially the midpoint of fourth planar member first fold line 430 to substantially the midpoint of the fourth planar member fourth edge 408. The cooperating first planar member second joining area 170 is located on the first planar member second surface 120 and is bounded by the first planar member first edge 102, the first planar member second edge 104, the first planar member first fold line 130, and an imaginary line extending from substantially the midpoint of first planar member first fold line 130 to substantially the midpoint of the first planar member fourth edge 108.

Lastly, and still referring to FIG. 1, the fourth planar member second joining area 470 is bounded by the fourth planar member first edge 402, the fourth planar member second edge 404, the fourth planar member second fold line 440, and an imaginary line extending from substantially the midpoint of fourth planar member second fold line 440 to substantially the midpoint of the fourth planar member second edge 404. The cooperating second planar member second joining area 270 is located on the second planar member second surface 220 and is bounded by the second planar member first edge 202, the second planar member second edge 204, the second planar member first fold line 230, and an imaginary line extending from substantially the midpoint of second planar member first fold line 230 to substantially the midpoint of the second planar member second edge 204.

As the mechanism of the puzzle illusion is the creation of an apparently endless numbers of pass-throughs, it will be apparent to one skilled in the art that the manipulation of the puzzle may be begun in many possible orientations. By way of example and not limitation, and referring specifically to FIGS. 2 through 5, the puzzle may be successfully manipulated in the following steps, with folding directions given in relation to the puzzle solver facing the puzzle.

Figure 3:
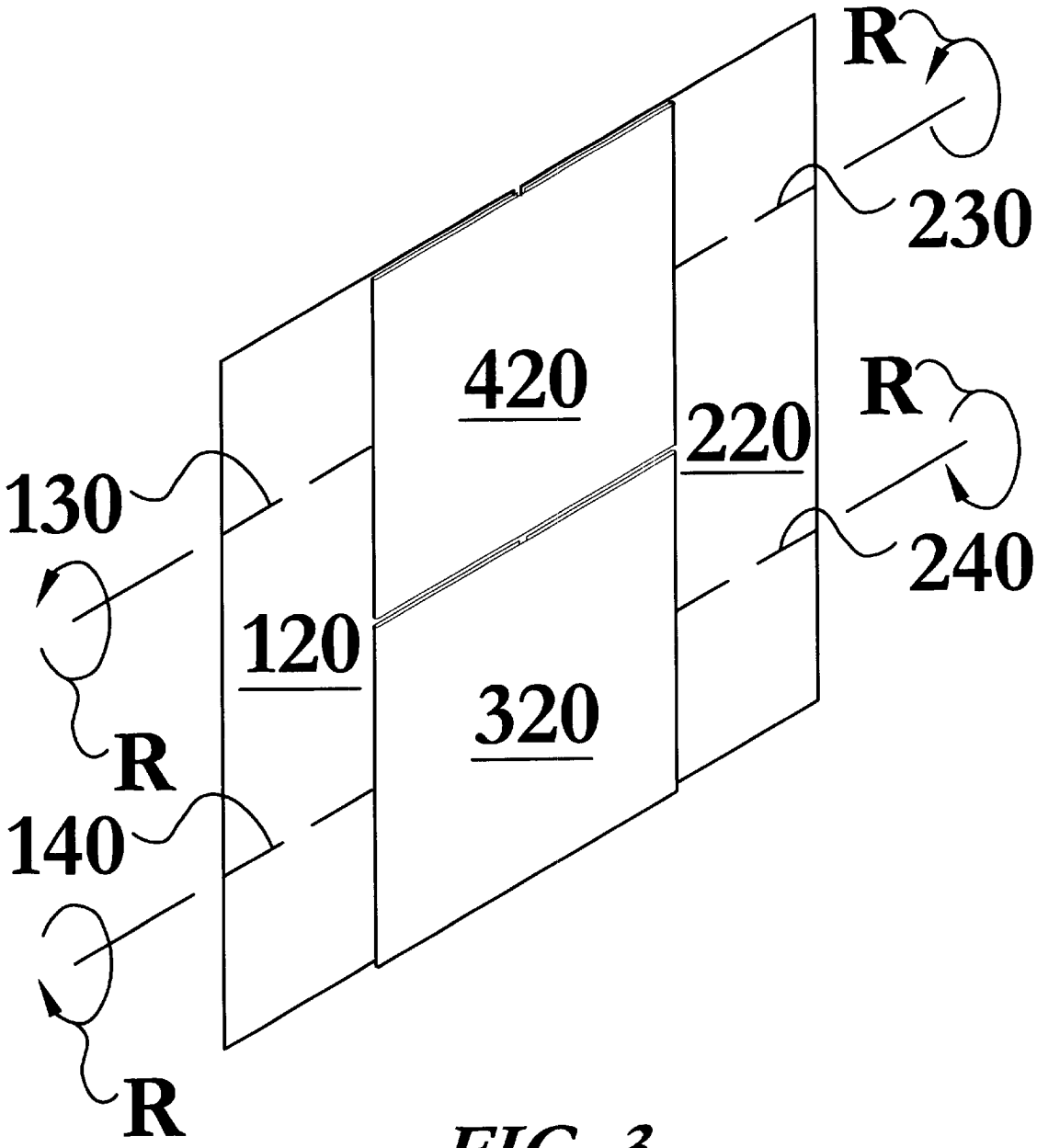
FIG. 3 shows the folding puzzle of FIG. 1 in elevated perspective view, in reduced scale.

The puzzle may be held in front of the puzzle solver with the first planar member 100 and the second planar member 200 oriented vertically with the first planar member first surface 110 oriented towards the solver and on the solver's left side and the second planar member first surface 210 oriented towards the solver and on the solver's right side, as illustrated in FIG. 1. The first planar member 100 may then be rotated to the left and outwardly, as indicated by rotation reference R, around a rotational line connecting the third planar member first fold line 330 and the fourth planar member first fold line 430. This maneuver exposes the outer aspect of the first planar member second surface 120, the left lateral aspect of the third planar member second surface 320, and the left lateral aspect of the fourth planar member 420. The second planar member 200 may then be rotated to the right and outwardly, as indicated by rotation reference R, around a rotational line connecting the third planar member second fold line 340 and the fourth planar member second fold line 440. This maneuver exposes the outer aspect of the second planar member second surface 220, the right lateral aspect of the third planar member second surface 320, and the right lateral aspect of the fourth planar member 420, as illustrated in FIG. 3.

Figure 4:
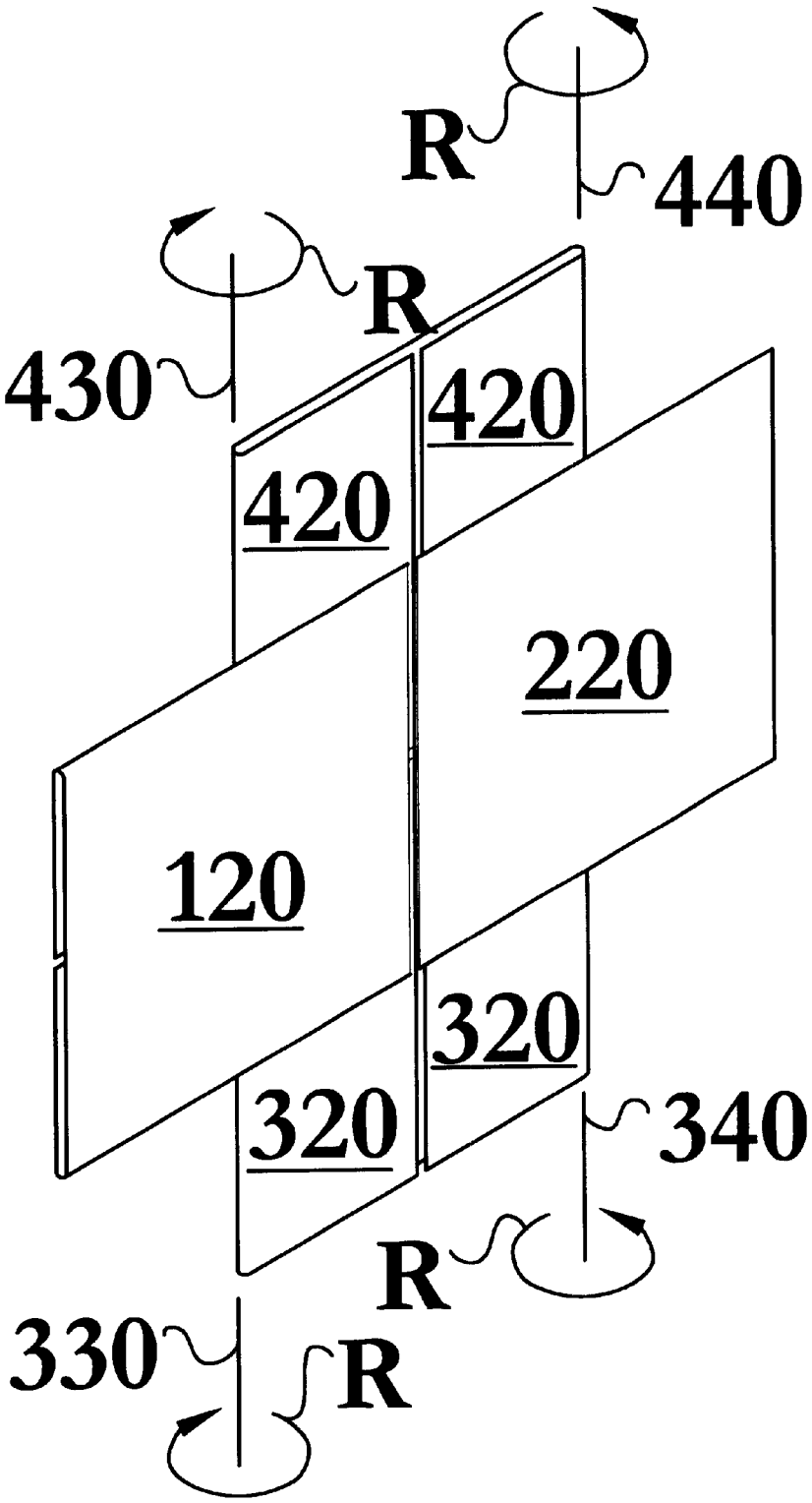
FIG. 4 shows the folding puzzle of FIG. 1 in elevated perspective view, in reduced scale.

Next, the fourth planar member 400 may be rotated upwards and outwardly, as indicated by rotation reference R, around a rotational line connecting the first planar member first fold line 130 and the second planar member first fold line 230. This exposes a portion of the fourth planar member second surface 420, an additional portion of the first planar member second surface 120, and an additional portion of the second planar member second surface 220, as shown in FIG. 4. Next, the third planar member 300 may be rotated downwards and outwardly around a rotational line, as indicated by rotation reference R, connecting the first planar member second fold line 140 and the second planar member second fold line 240. This exposes a portion of the third planar member second surface 320, an additional portion of the first planar member second surface 120, and an additional portion of the second planar member second surface 220, as seen in FIG. 4.

Figure 5:
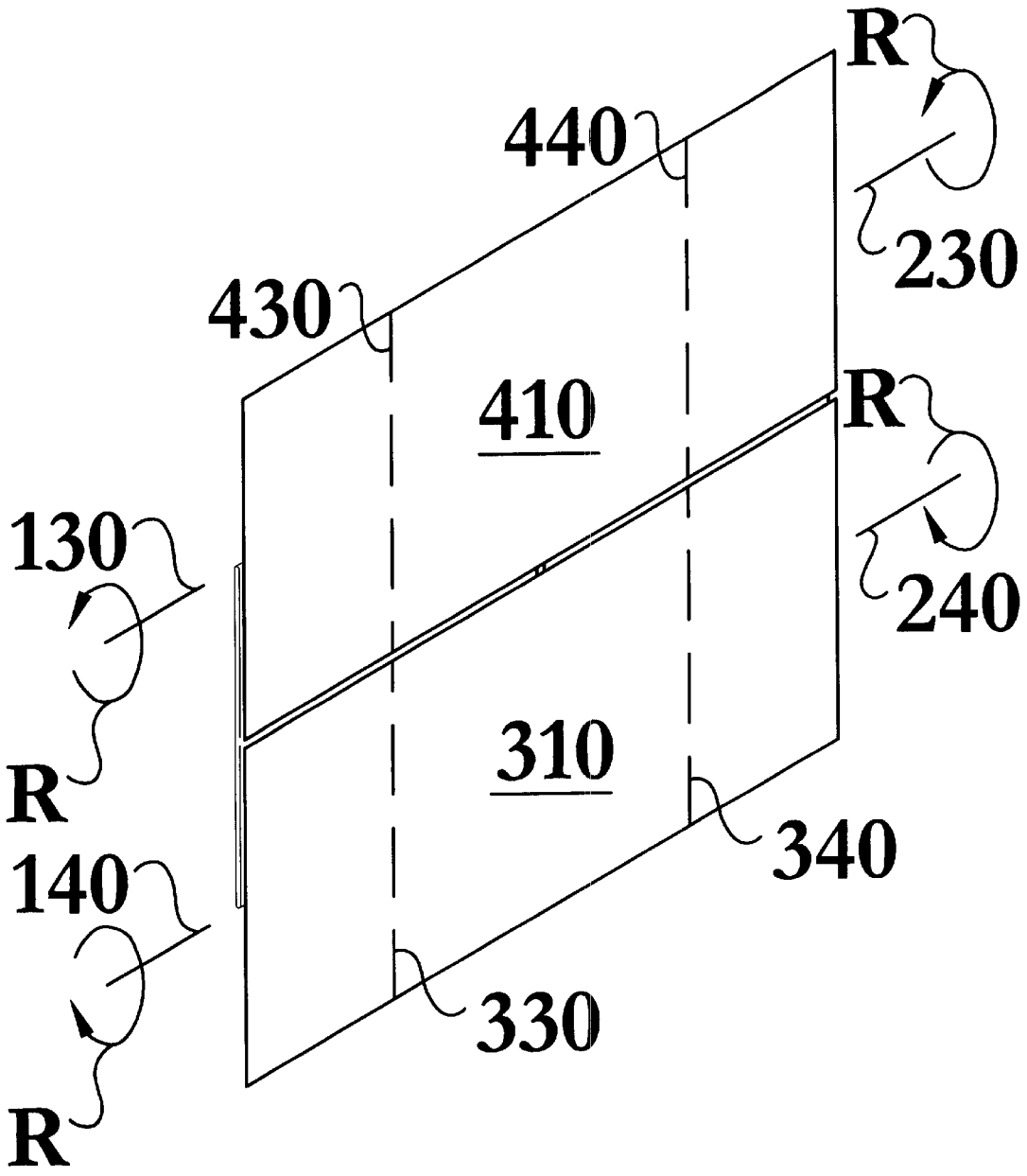
FIG. 5 shows the folding puzzle of FIG. 1 in elevated perspective view, in reduced scale.

The puzzle solution continues by rotating the left lateral aspect of the third planar member 300 and the left lateral aspect of the fourth planar member 400 about a rotational line, as indicated by rotation reference R, connecting the third planar member first fold line 330 and the fourth planar member first fold line 430, and by rotating the right lateral aspect of the third planar member 300 and the right lateral aspect of the fourth planar member 400 about a rotational line, as indicated by rotation reference R, connecting the third planar member second fold line 340 and the fourth planar member second fold line 440. This exposes the full surface of the third planar member first surface 310 and the full surface of the fourth planar member first surface 410, as seen in FIG. 5.

Figure 2:
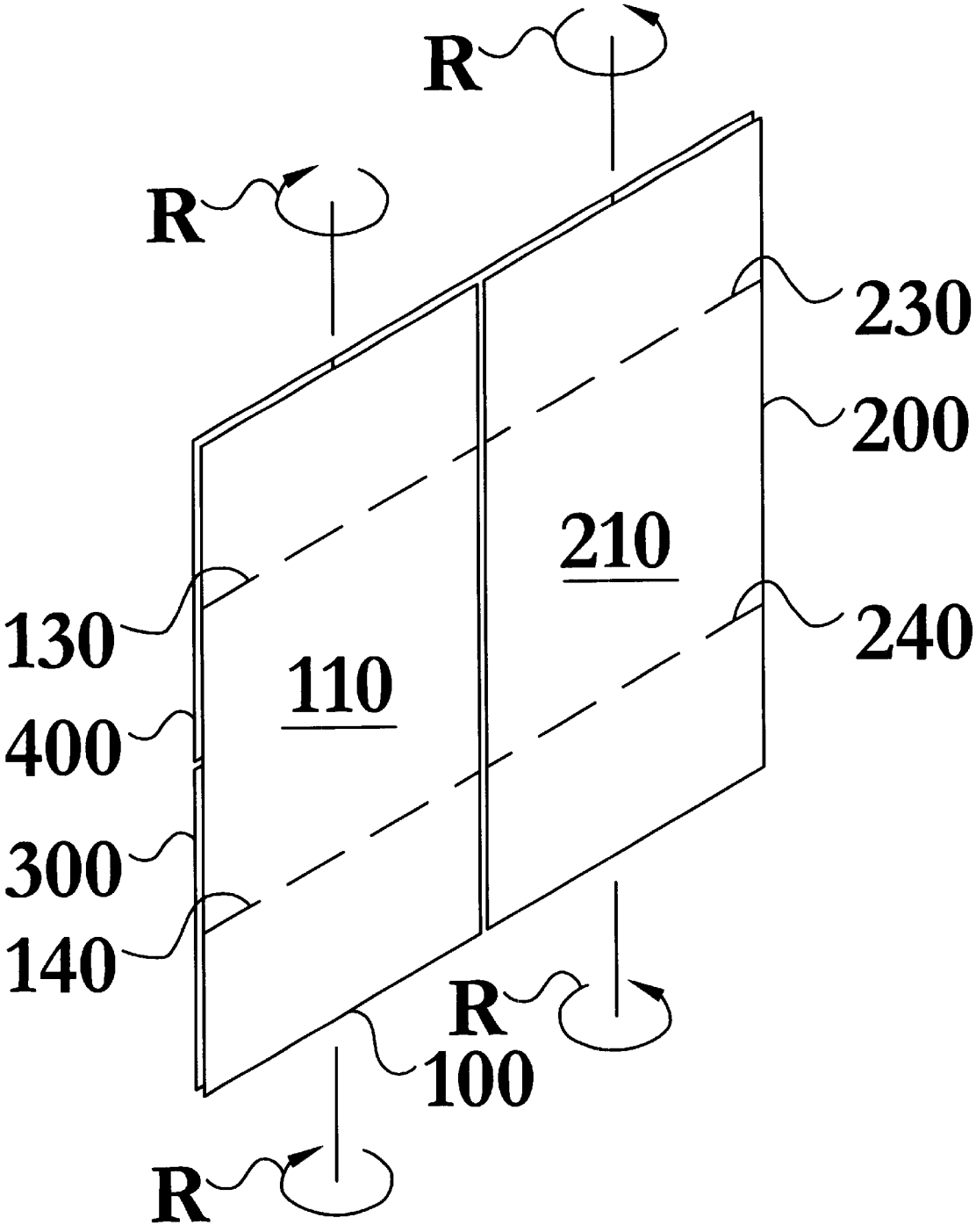
FIG. 2 shows the folding puzzle of FIG. 1 in elevated perspective view, in reduced scale.

The puzzle solution may then be completed by rotating the third planar member 300 downwards and outwardly, as indicated by rotation reference R, about a rotational line connecting first planar member second fold line 140 and the second planar member second fold line 240, and by rotating the fourth planar member 400 upwards and outwardly around a rotational line, as indicated by rotation reference R, connecting first planar member first fold line 130 and the second planar member first fold line 230. This returns the puzzle to its original configuration as seen in FIG. 2, completing the puzzle and fostering the illusion that the paper has been passed through itself. The process may be repeated a countless number of time, with each repetition serving to further engage the puzzle solver in deciphering the illusion.

With reference specifically now to FIGS. 6 through 15, in another one of the many preferable embodiments, the fold-through puzzle may be constructed from a single, incised, planar member 500. Such a configuration, because it uses a single planar member 500, increases the illusion that the puzzle accomplished an impossible task.

Figure 6:
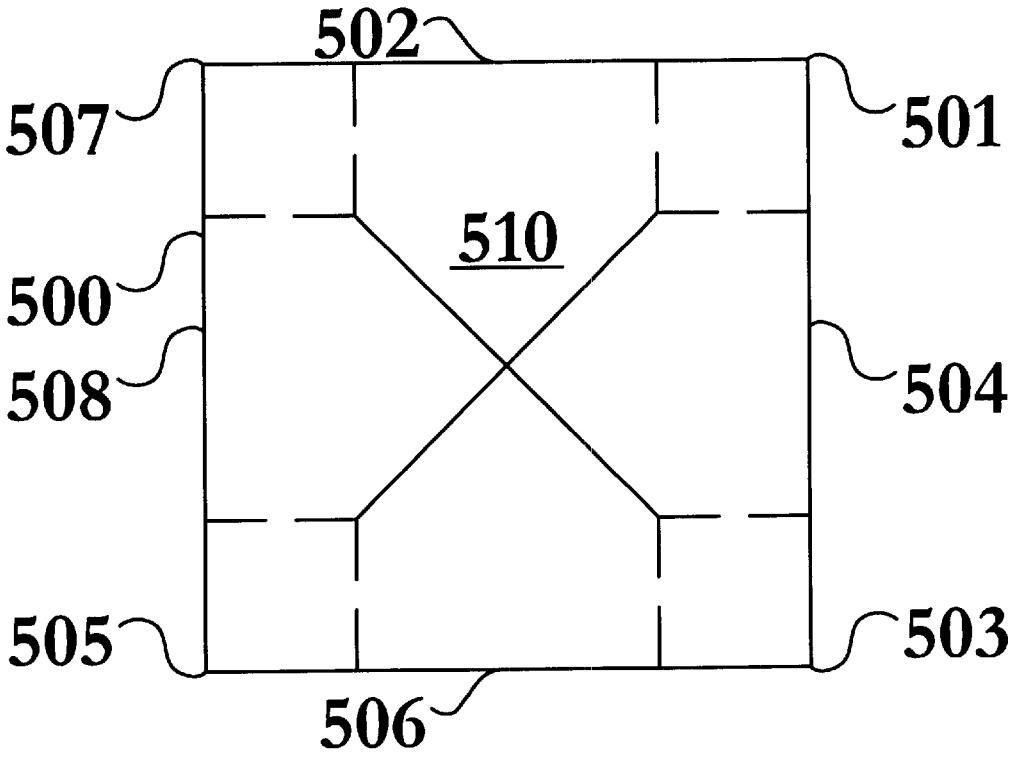
FIG. 6 shows a variation of the folding puzzle of FIG. 1 in top plan view, in reduced scale.
Figure 7:
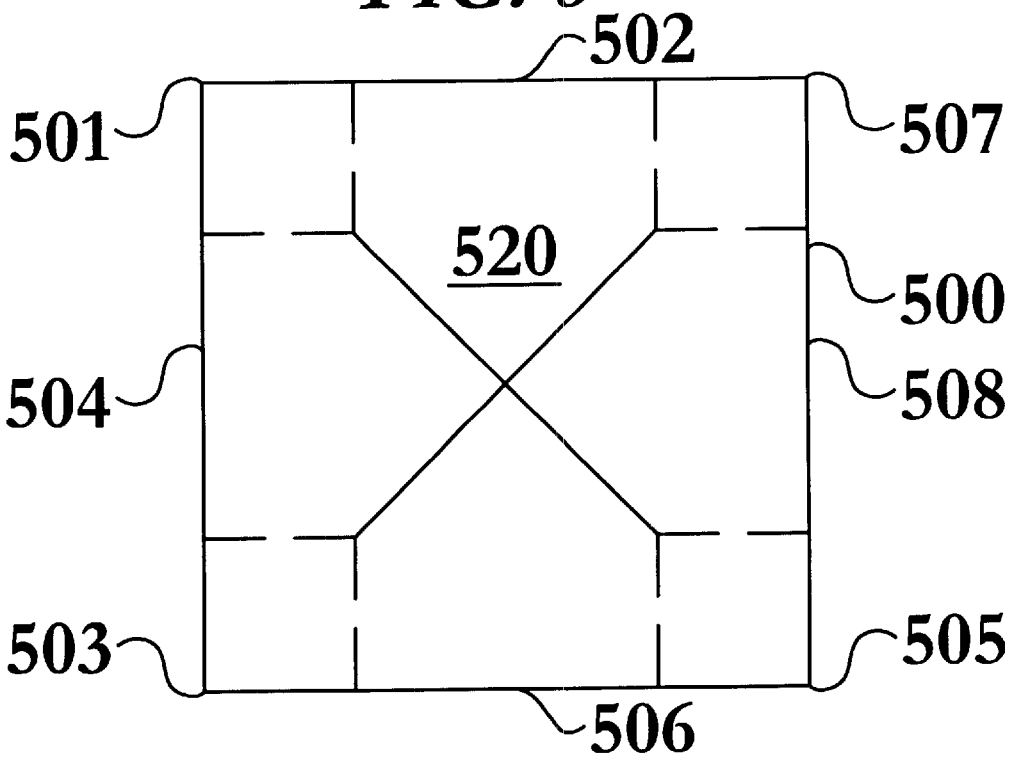
FIG. 7 shows the back side of the folding puzzle of FIG. 6 in plan view, in reduced scale.

In such configuration, illustrated in FIG. 6, the fold-through puzzle includes a single sheet base having a planar member 500 with a defined center point 999. Such an embodiment further comprises a first corner 501, a second corner 503, a third corner 505, and a fourth corner 507. Such configuration results in a first edge 502 connecting the fourth 507 and first corners 501, a second edge 504 connecting the first 501 and second corners 503, a third edge 506 connecting the second 503 and third corners 505, and a fourth edge 508 connecting the third 505 and fourth corners 507. The planar member 500 has a first surface 510, seen in FIG. 6, and a second surface 520, seen in FIG. 7.

Figure 8:
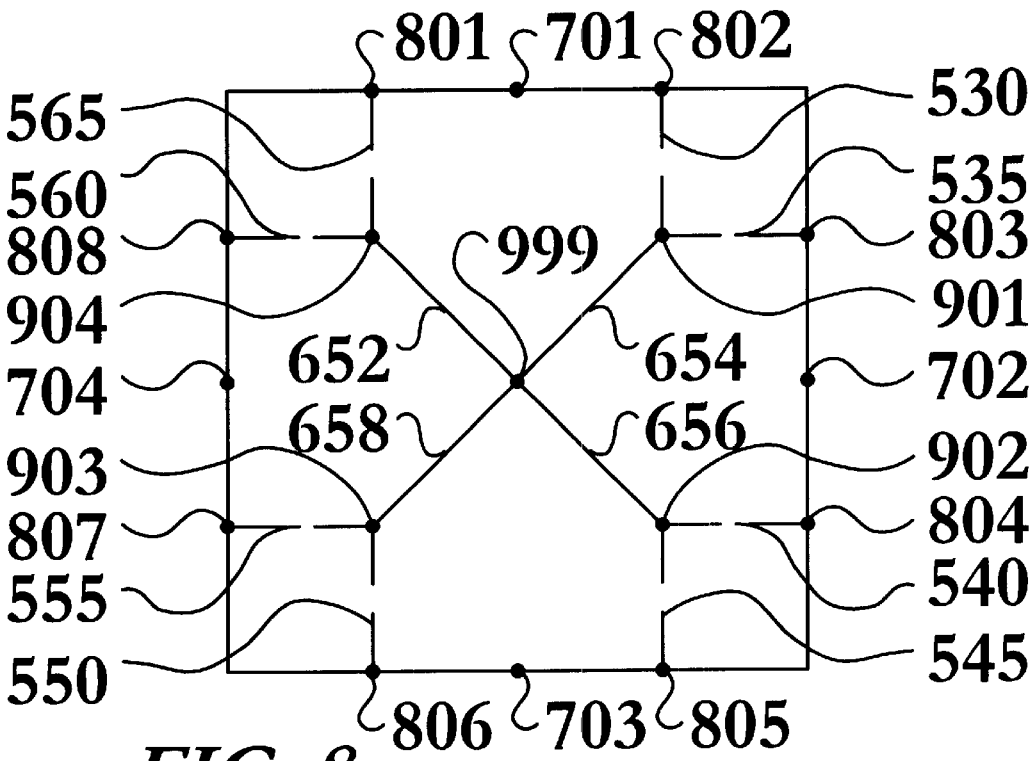
FIG. 8 shows the folding puzzle of FIG. 6 in top plan view, in reduced scale.

The operation of such an embodiment is best understood by first identifying a number of points on the surface of the puzzle, as illustrated in FIG. 8.

The sheet base may include a center point 999 of the planar member 500, a first primary midpoint 701 at the midpoint of the first edge 502, a second primary midpoint 702 at the midpoint of the second edge 504, a third primary midpoint 703 at the midpoint of the third edge 506, and a fourth primary midpoint 704 at the midpoint of the fourth edge 508.

With reference now to FIG. 6 and FIG. 8, there may be a first secondary midpoint 801 at the point along the first edge 502 at the midpoint between the fourth corner 507 and the first primary midpoint 701 and a second secondary midpoint 802 at the point along the first edge 502 at the midpoint between the first primary midpoint 701 and the first corner 501. There may be a third secondary midpoint 803 at the point along the second edge 504 at the midpoint between the first corner 501 and the second primary midpoint 702 and a fourth secondary midpoint 804 at the point along the second edge 504 at the midpoint between the second primary midpoint 702 and the second corner 503. There may be a fifth secondary midpoint 805 at the point along the third edge 506 at the midpoint between the second corner 503 and the third primary midpoint 703 and a sixth secondary midpoint 806 at the point along the third edge 506 at the midpoint between the third primary midpoint 703 and the third corner 505. There may be a seventh secondary midpoint 807 at the point along the fourth edge 508 at the midpoint between the third corner 505 and the fourth primary midpoint 704 and an eighth secondary midpoint 808 at the point along the fourth edge 508 at the midpoint between the fourth primary midpoint 704 and the fourth corner 507.

With continued reference to FIG. 8, there is a first tertiary midpoint 901 at the midpoint of a line connecting the first primary midpoint 701 and the second primary midpoint 702, a second tertiary midpoint 902 at the midpoint of a line connecting the second primary midpoint 702 and the third primary midpoint 703, a third tertiary midpoint 903 at the midpoint of a line connecting the third primary midpoint 703 and the fourth primary midpoint 704, and a fourth tertiary midpoint 904 at the midpoint of a line connecting the fourth primary midpoint 704 and the first primary midpoint 701.

Reference to the abovementioned points identifies at least one incision through the square planar member 500. There is a first incision 652 through the square planar member 500 connecting the fourth tertiary midpoint 904 and the center point 999 of the square planar member 500 and a second incision 654 through the square planar member 500 connecting the first tertiary midpoint 901 and the center point 999 of the square planar member 500. There is a third incision 656 through the square planar member 500 connecting the second tertiary midpoint 902 and the center point 999 of the square planar member 500 and a fourth incision 658 through the square planar member 500 connecting the third tertiary midpoint 903 and the center point 999 of the square planar member 500.

Reference to the abovementioned points identifies fold and pivot lines, about which the puzzle is manipulated in order to give rise to the puzzle illusion. Referring still to FIG. 8, the single planar member 500 displays a plurality of fold lines, such that there may be a first fold line 535 connecting the second secondary midpoint 802 and the first tertiary midpoint 901 and a second fold line 535 connecting the third secondary midpoint 803 and the first tertiary midpoint 901. There may be a third fold line 540 connecting the fourth secondary midpoint 804 and the first tertiary midpoint 902 and a fourth fold line 545 connecting the fifth secondary midpoint 805 and the second tertiary midpoint 902. There may be a fifth fold line 550 connecting the sixth secondary midpoint 806 and the third tertiary midpoint 903 and a sixth fold line 555 connecting the seventh secondary midpoint 807 and the third tertiary midpoint 903. There may be a seventh fold line 560 connecting the eighth secondary midpoint 808 and the fourth tertiary midpoint 904 and an eighth fold line 565 connecting the first secondary midpoint 801 and the fourth tertiary midpoint 904.

Figure 9:
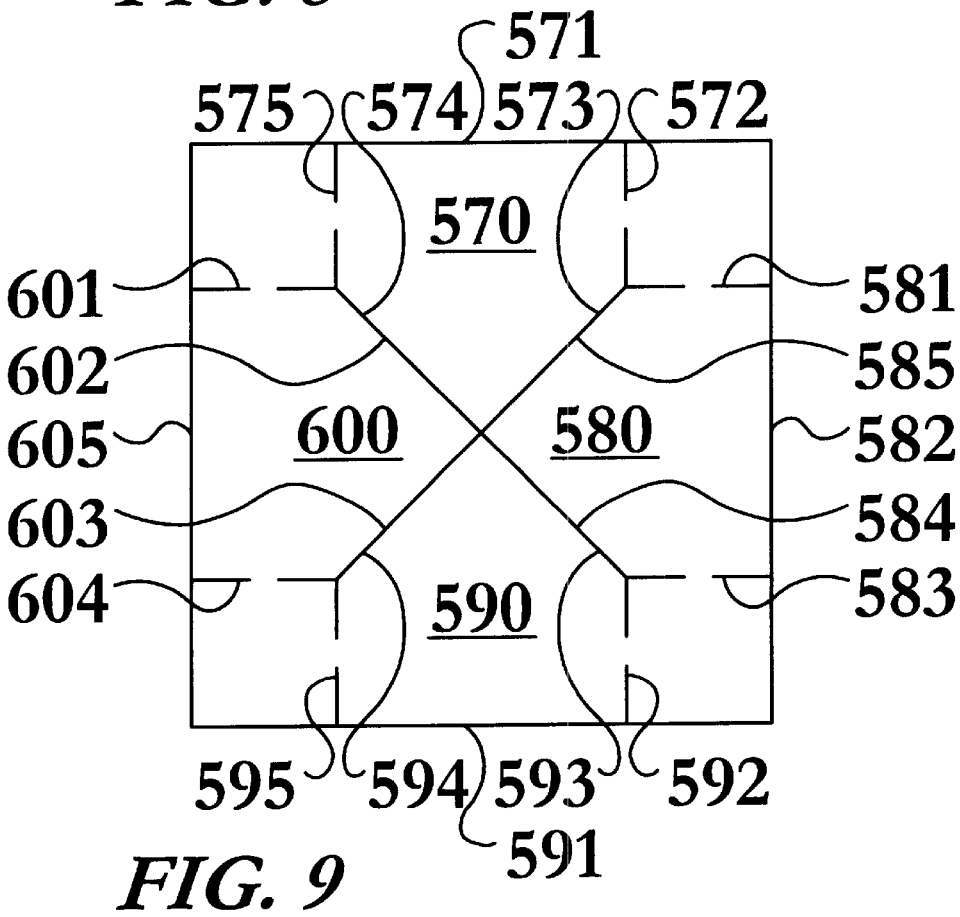
FIG. 9 shows the folding puzzle of FIG. 6 in top plan view, in reduced scale.
Figure 10:
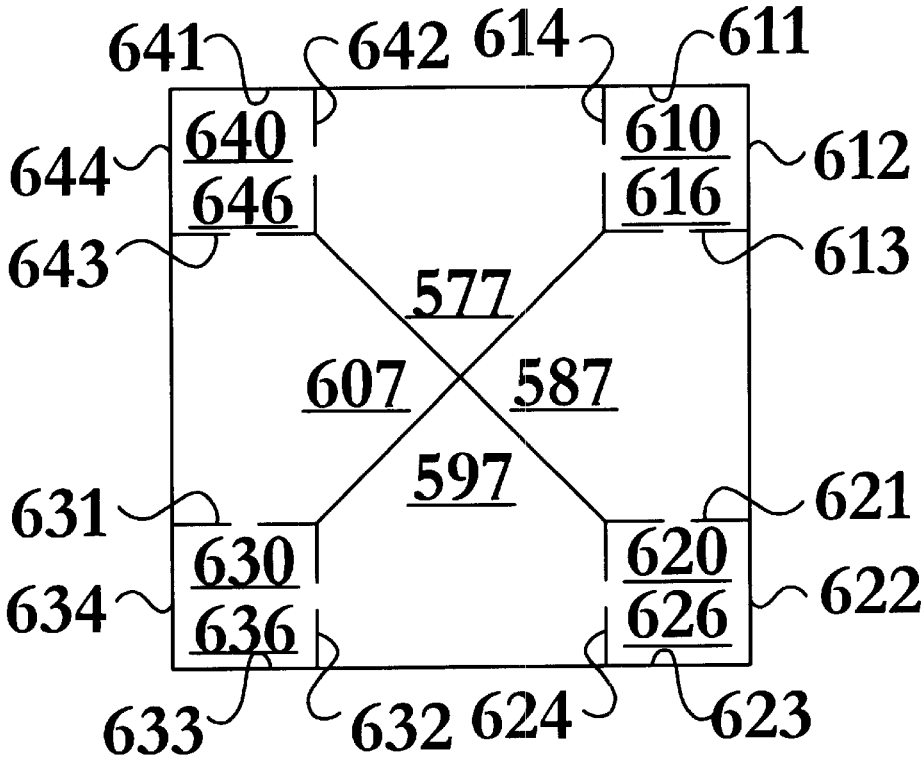
FIG. 10 shows the folding puzzle of FIG. 6 in top plan view, in reduced scale.
Figure 11:
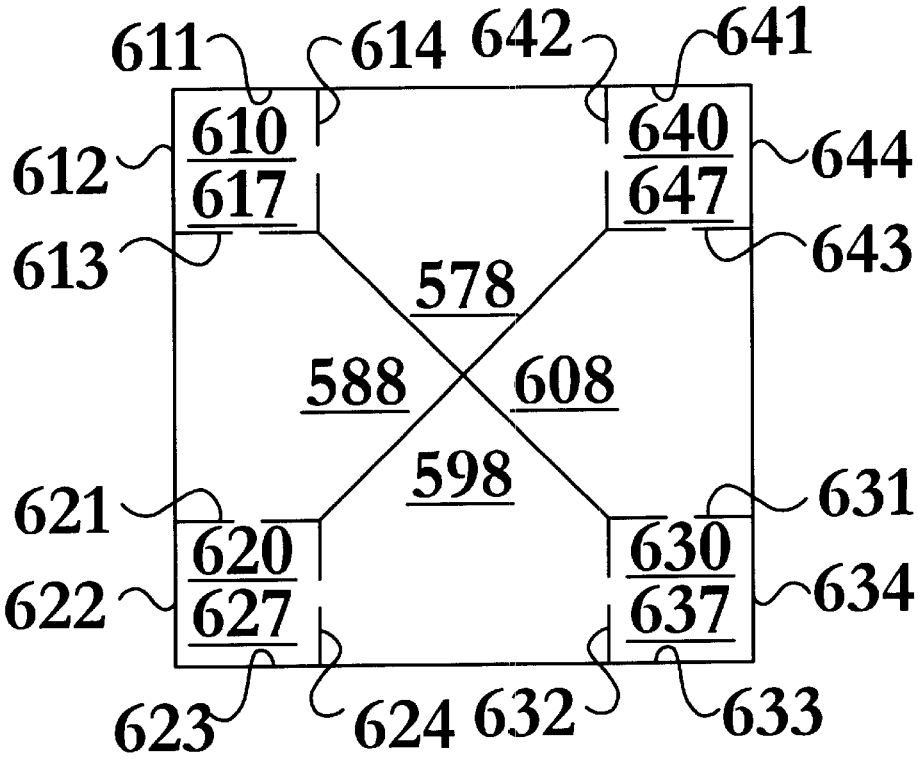
FIG. 11 shows the back side of the folding puzzle of FIG. 6 in plan view, in reduced scale

Referring now to FIG. 9, the single planar member 500 displays a plurality of pivot areas, such that there is a first pivot area 570 having a first side 571 defined by the first edge 502, a second side 572 defined by the second fold line 530, a third side 573 defined by the second incision 654, a fourth side 574 defined by the first incision 652, and a fifth side 575 defined by the eighth fold line 565, the first pivot area 570 additionally having a first surface 577 as illustrated in FIG. 10 and a second surface 578 as illustrated in FIG. 11.

Referring again to FIG. 9, there is a second pivot area 580 having a first side 581 defined by the second fold line 535, a second side 582 defined by the second edge 504, a third side 583 defined by the third fold line 540, a fourth side 584 defined by the third incision 656, and a fifth side 585 defined by the third incision 656, the second pivot area 580 additionally having a first surface 587 as illustrated in FIG. 10 and a second surface 588, as illustrated in FIG. 11.

Referring again to FIG. 9, there is a third pivot area 590 having a first side 591 defined by the third edge 506, a second side 592 defined by the fourth fold line 545, a third side 593 defined by the third incision 656, a fourth side 594 defined by the fourth incision 656, and a fifth side 595 defined by the fifth fold line 550, the third pivot area additionally having a first surface 597 as illustrated in FIG. 10 and a second surface 598, as illustrated in FIG. 11.

Also referring to FIG. 9, there is a fourth pivot area 600 having a first side 601 defined by the seventh fold line 560, a second side 602 defined by the first incision 652, a third side 603 defined by the fourth incision 658, a fourth side 604 defined by the sixth fold line 555, and a fifth side 605 defined by the fourth edge 508, the fourth pivot area 600 additionally having a first surface 607 as illustrated in FIG. 10 and a second surface 608, as illustrated in FIG. 11.

Reference to the abovementioned fold and pivot lines also identifies corner areas of the puzzle. The single planar sheet 500 displays a plurality of corner areas, illustrated in FIG. 10 and FIG. 11, such that there is a first corner area 610 having a first side 611 defined by the first edge 502, a second side 612 defined by the second edge 504, a third side 613 defined by the second fold line 535 and a fourth side 614 defined by the first fold line 530, the first corner area additionally having a first surface 616 as illustrated in FIG. 10 and a second surface 617, as illustrated in FIG. 11.

Additionally, there is a second corner area 620 having a first side 621 defined by the third fold line 540, a second side 622 defined by the second edge 504, a third side 623 defined by the third edge 506, and a fourth side 624 defined by the fourth fold line 545, the second corner area 620 additionally having a first surface 626 as illustrated in FIG. 10 and a second surface 627, as illustrated in FIG. 11.

Similarly, there is a third corner area 630 having a first side 631 defined by the sixth fold line 555, a second side 632 defined by the fifth fold line 550, a third side 630 defined by the third edge 506, and a fourth side 634 defined by the fourth edge 508, the third corner 630 area additionally having a first surface 636 as illustrated in FIG. 10 and a second surface 637, as illustrated in FIG. 11.

Lastly, there is a fourth corner area 640 having a first side 641 defined by the first edge 502, a second side 642 defined by the eighth fold line 565, a third side 643 defined by the seventh fold line 560 and a fourth side 644 defined by the fourth edge 508, the fourth corner area 640 additionally having a first surface 646 as illustrated in FIG. 10 and a second surface 647, as illustrated in FIG. 11.

As the mechanism of the puzzle illusion is the creation of an apparently endless numbers of pass-throughs, it will be apparent to one skilled in the art that the manipulation of the puzzle may be begun in many possible orientations. By way of example and not limitation, and referring specifically to FIGS. 12 through 15, the puzzle may be successfully manipulated in the following steps, with folding and pivoting directions given in relation to the puzzle solver facing the puzzle.

Figure 12:
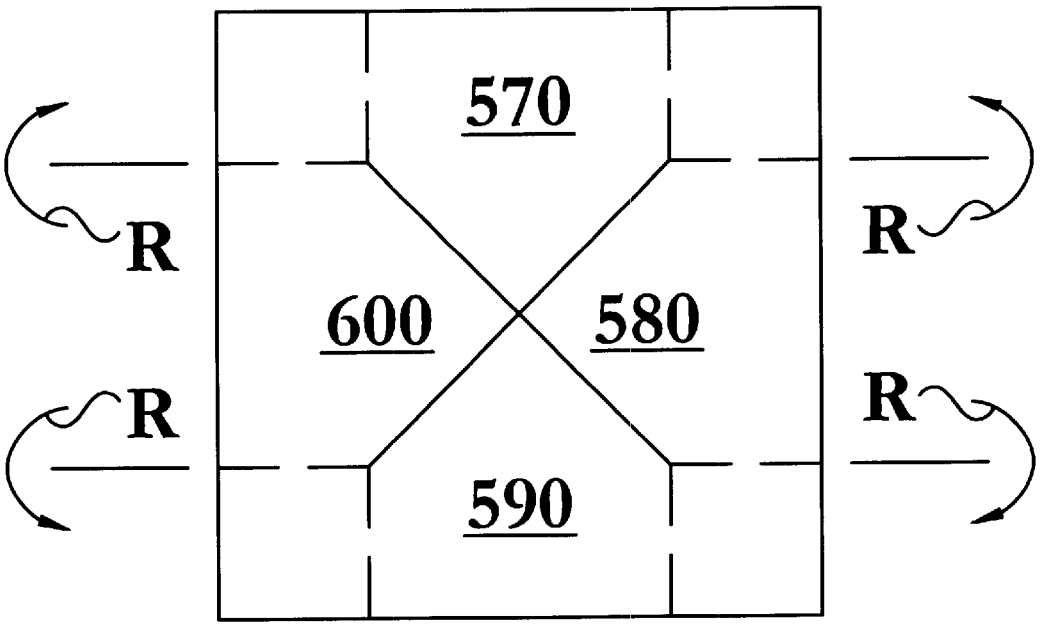
FIG. 12 shows the folding puzzle of FIG. 6 in top plan view, in reduced scale.

The puzzle solution may begin with the puzzle solver facing the planar member 500 from the first planar member first surface 510 as seen in FIG. 6, and viewing pivot areas 570, 580, 590, and 600, as seen in FIG. 12. The first manipulation may be of pivoting the first pivot area 570 backwards and upwards, as indicated by rotational reference letter R, by simultaneously folding the fourth corner area 640 along the seventh fold line 560 and the first corner area 610 along the second fold line 535, such that the fourth corner area 640 lies behind the fourth pivot area 600 and the first corner area 610 lies behind the second pivot area 580.

Next, the puzzle solver pivots the third pivot area downwards, as indicated by rotational reference letter R, by simultaneously folding the second corner area 620 along the third fold line 540 and the third corner area 630 along the sixth fold line 555, such that the second corner area 620 lies behind the second pivot area 580 and the third corner area 630 lies behind the fourth pivot area 600. This produces the configuration seen in FIG. 13, and exposes a portion of the first pivot area second surface 578, the second pivot area first surface 587, a portion of the third pivot area second surface 598, and the fourth pivot area first surface 607.

Figure 13:
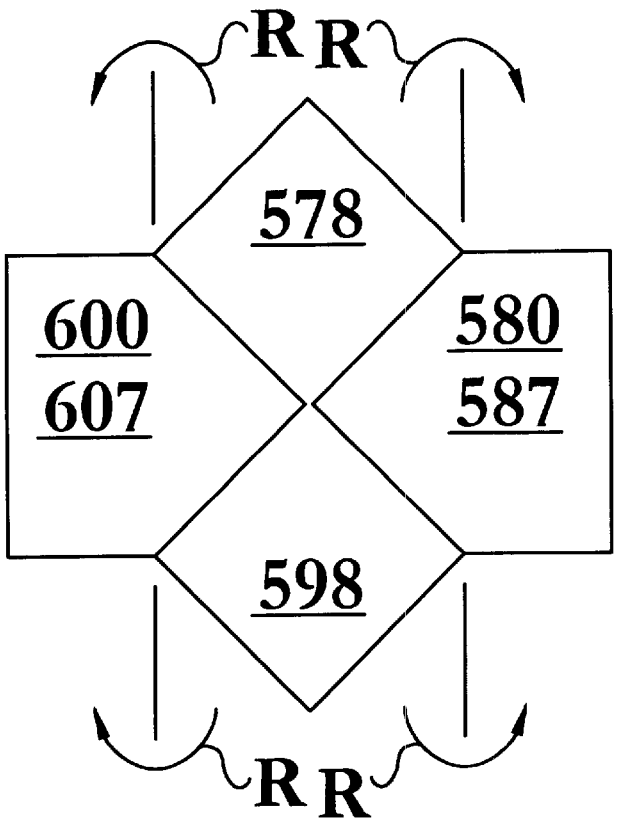
FIG. 13 shows the folding puzzle of FIG. 6 in top plan view, in reduced scale.

The puzzle continues from the position seen in FIG. 13. The puzzle solver pivots the fourth pivot area 600 to the left and the second pivot area 580 to the right, as indicated by rotational reference letter R. This reveals all of the first pivot area second surface 578 and the third pivot area second surface portion 598, as well as a portion of the fourth pivot area second surface 608 and a portion of the second pivot area second surface 588, thereby producing the configuration as seen in FIG. 14.

Figure 14:
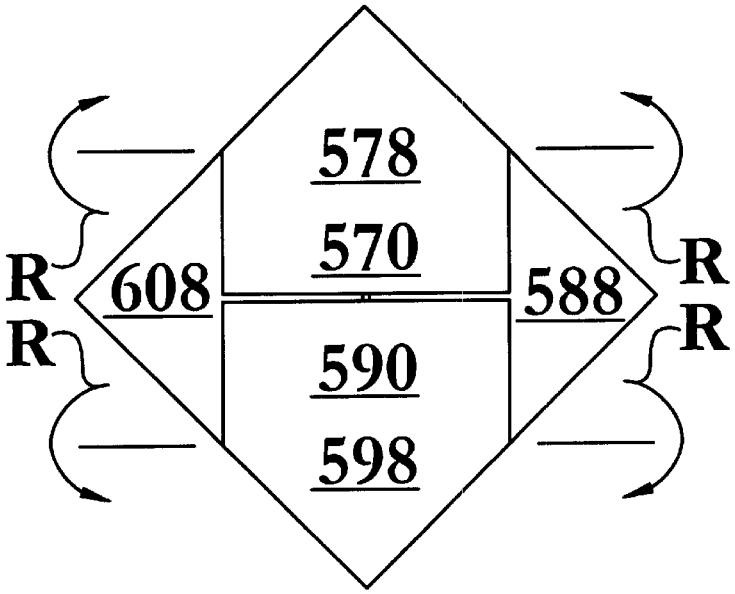
FIG. 14 shows the folding puzzle of FIG. 6 in top plan view, in reduced scale.

The puzzle continues from the position seen in FIG. 14. The puzzle solver pivots the first pivot area 570 upwards and the third pivot area 590 downwards, as indicated by rotational reference letter R, thus exposing fourth corner area second surface 647, the first corner area second surface 617, the second pivot area second surface 588, the second corner area second surface 627, the third corner area second surface 637, and the fourth pivot area second surface 608, thereby producing the configuration as seen in FIG. 15.

Figure 15:
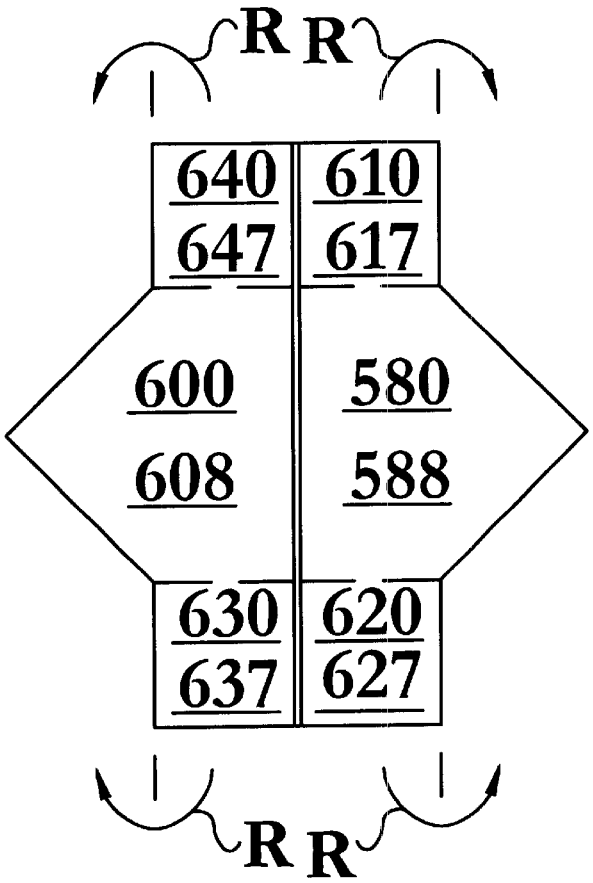
FIG. 15 shows the folding puzzle of FIG. 6 in top plan view, in reduced scale.

Beginning with the position as seen in FIG. 15, the puzzle is completed and returned to its original configuration by pivoting the fourth pivot area 600 to the left and outwards, as indicated by rotational reference letter R, by simultaneously folding the fourth corner area 640 outwards and to the left, along the eighth fold line 565, and the third corner area 630 outwards and to the left along the fifth fold line 550, and then folding the second pivot area 580 outwards and to the right, as indicated by rotational reference letter R, by simultaneously folding the first corner area 610 along the first fold line 530 and the second corner area 630 along the fourth fold line 545. This maneuver completes the puzzle and the illusion thereof and returns the puzzle to the opening configuration seen in FIG. 12.

In the various embodiments, it is envisioned that the planar surface or surfaces of the puzzle will have generally cooperating sections of differing color, imagery or text; or some combination thereof; imprinted on them. The folding of the puzzle will cause a change in the relative positions of the cooperating sections so as to produce an arresting or amusing image to the puzzle viewer. Such cooperating sections may be formed with advertising indicia, such as text or imagery, or may be configured purely for the amusement of the viewer. Additionally, such cooperating segments may differ in the textural or other surface characteristics.

These variations, modifications, alternatives, and alterations of the various preferred embodiments, arrangements, and configurations may be used alone or in combination with one another as will become more readily apparent to those with skill in the art with reference to the following detailed description of the preferred embodiments and the accompanying figures and drawings.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims.

I claim:

1. A folding puzzle, comprising:

a first planar member having a first surface, a second surface, a first fold line, and a second fold line;

a second planar member, substantially coplanar with the first planar member, having a first surface, a second surface, a first fold line, and a second fold line;

a third planar member having a first surface, a second surface, a first fold line, and a second fold line wherein the first planar member second surface and the third planar member second surface are joined in part at a first joining location and the second planar member second surface and the third planar member second surface are joined in part at a second joining location; and a fourth planar member, substantially coplanar with the third planar surface, having a first surface, a second surface, a first fold line, and a second fold line wherein the first planar member second surface and the fourth planar member second surface are joined in part at a third joining location and the second planar member second surface and the fourth planar member second surface are joined in part at a fourth joining location, wherein (a) the first planar member may pivot about the first fold line of the third planar member and the first fold line of the fourth planar member, (b) the second planar member may pivot about the second fold line of the third planar member and the second fold line of the fourth planar member, (c) the third planar member may pivot about the second fold line of the first planar member and the second fold line of the second planar member, and (d) the fourth planar member may pivot about the first fold line of the first planar member and the first fold line of the second planar member.

2. The folding puzzle to claim 1, wherein the first planar member is substantially rectangular and formed with a first edge, a second edge, a third edge, and a fourth edge; the second planar member is substantially rectangular and formed with a first edge, a second edge, a third edge, and a fourth edge; the third planar member is substantially rectangular and formed with a first edge, a second edge, a third edge, and a fourth edge; and the fourth planar member is substantially rectangular and formed with a first edge, a second edge, a third edge, and a fourth edge.

3. The folding puzzle to claim 2, wherein (a) the first planar member first fold line and the first planar member second fold line are substantially parallel to the first planar member second edge and the first fold line is located approximately one quarter of the length of the first planar member first edge away from the second edge and the second fold line is located approximately three quarters of the length of the first planar member first edge away from the second edge, (b) the second planar member first fold line and the second planar member second fold line are substantially parallel to the second planar member second edge and the first fold line is located approximately one quarter of the length of the second planar member first edge away from the second edge and the second fold line is located approximately three quarters of the length of the first planar member first edge away from the second edge, (c) the third planar member first fold line and the third planar member second fold line are substantially parallel to the third planar member second edge and the first fold line is located approximately one quarter of the length of the third planar member first edge away from the second edge and second fold line is located approximately three quarters of the length of the third planar member first edge away from the second edge, and (d) the fourth planar member first fold line and the fourth planar member second fold line are substantially parallel to the fourth planar member second edge and the first fold line is located approximately one quarter of the length of the fourth planar member first edge away from the second edge and second fold line is located approximately three quarters of the length of the fourth planar member first edge away from the second edge.

4. The folding puzzle of claim 2, wherein (a) the first joining location joins a third planar member first joining area and a first planar member first joining area, (b) the second joining location joins a third planar member second joining area and a second planar member first joining area, (c) the third joining location joins a fourth planar member first joining area and a first planar member second joining area, and (d) the fourth joining location joins a fourth planar member second joining area and a second planar member second joining area.

5. The folding puzzle to claim 2, wherein (a) the first joining area is located on the third planar member second surface and is bounded by the third planar member first edge, the third planar member second edge, the third planar member first fold line, and an imaginary line extending from substantially the midpoint of third planar member first fold line to substantially the midpoint of the third planar member second edge and the cooperating first joining area is located on the first planar member second surface and is bounded by the first planar member first edge, the first planar member fourth edge, the first planar member second fold line, and an imaginary line extending from substantially the midpoint of first planar member second fold line to substantially the midpoint of the first planar member fourth edge; (b) the second joining area is located on the third planar member second surface and is bounded by the third planar member first edge, the third planar member fourth edge, the third planar member second fold line, and an imaginary line extending from substantially the midpoint of third planar member second fold line to substantially the midpoint of the third planar member fourth edge and the cooperating first joining area is located on the second planar member second surface and is bounded by the second planar member first edge, the second planar member fourth edge, the second planar member second fold line, and an imaginary line extending from substantially the midpoint of second planar member second fold line to substantially the midpoint of the second planar member fourth edge; (c) the first joining area is located on the fourth planar member second surface and is bounded by the fourth planar member first edge, the fourth planar member fourth edge, the fourth planar member first fold line, and an imaginary line extending from substantially the midpoint of fourth planar member first fold line to substantially the midpoint of the fourth planar member fourth edge and the cooperating second joining area is located on the first planar member second surface and is bounded by the first planar member first edge, the first planar member second edge, the first planar member first fold line, and an imaginary line extending from substantially the midpoint of first planar member first fold line to substantially the midpoint of the first planar member fourth edge; and (d) the second joining area is located on the fourth planar member second surface and is bounded by the fourth planar member first edge, the fourth planar member second edge, the fourth planar member second fold line, and an imaginary line extending from substantially the midpoint of fourth planar member second fold line to substantially the midpoint of the fourth planar member second edge and the cooperating second joining area is located on the second planar member second surface and is bounded by the second planar member first edge, the second planar member second edge, the second planar member first fold line, and an imaginary line extending from substantially the midpoint of second planar member first fold line to substantially the midpoint of the second planar member second edge.

6. A folding puzzle, comprising:

a first planar member having a first surface, a second surface, a first fold line, and a second fold line, wherein the first planar member is substantially rectangular and formed with a first edge, a second edge, a third edge, and a fourth edge;

a second planar member, substantially coplanar with the first planar member, having a first surface, a second surface, a first fold line, and a second fold line, wherein the second planar member is substantially rectangular and formed with a first edge, a second edge, a third edge, and a fourth edge;

a third planar member having a first surface, a second surface, a first fold line, and a second fold line wherein the third planar member is substantially rectangular and formed with a first edge, a second edge, a third edge, and a fourth edge, and the first planar member second surface and the third planar member second surface are joined in part at a first joining location and the second planar member second surface and the third planar member second surface are joined in part at a second joining location;

a fourth planar member, substantially coplanar with the third planar surface, having a first surface, a second surface, a first fold line, and a second fold line wherein the fourth planar member is substantially rectangular and formed with a first edge, a second edge, a third edge, and a fourth edge, and the first planar member second surface and the fourth planar member second surface are joined in part at a third joining location and the second planar member second surface and the fourth planar member second surface are joined in part at a fourth joining location, wherein (a) the first planar member may pivot about the first fold line of the third planar member and the first fold line of the fourth planar member, (b) the second planar member may pivot about the second fold line of the third planar member and the second fold line of the fourth planar member, (c) the third planar member may pivot about the second fold line of the first planar member and the second fold line of the second planar member, and (d) the fourth planar member may pivot about the first fold line of the first planar member and the first fold line of the second planar member; and the surface area of the first planar member first surface and the second planar member first surface is substantially equal to the surface area of the third planar member first surface and the fourth planar member first surface.

7. The folding puzzle to claim 6, wherein (a) the first planar member first fold line and the first planar member second fold line are substantially parallel to the first planar member second edge and the first fold line is located approximately one quarter of the length of the first planar member first edge away from the second edge and the second fold line is located approximately three quarters of the length of the first planar member first edge away from the second edge, (b) the second planar member first fold line and the second planar member second fold line are substantially parallel to the second planar member second edge and the first fold line is located approximately one quarter of the length of the second planar member first edge away from the second edge and the second fold line is located approximately three quarters of the length of the first planar member first edge away from the second edge, (c) the third planar member first fold line and the third planar member second fold line are substantially parallel to the third planar member second edge and the first fold line is located approximately one quarter of the length of the third planar member first edge away from the second edge and second fold line is located approximately three quarters of the length of the third planar member first edge away from the second edge, and (d) the fourth planar member first fold line and the fourth planar member second fold line are substantially parallel to the fourth planar member second edge and the first fold line is located approximately one quarter of the length of the fourth planar member first edge away from the second edge and second fold line is located approximately three quarters of the length of the fourth planar member first edge away from the second edge.

8. The folding puzzle of claim 7, wherein (a) the first joining location joins a third planar member first joining area and a first planar member first joining area, (b) the second joining location joins a third planar member second joining area and a second planar member first joining area, (c) the third joining location joins a fourth planar member first joining area and a first planar member second joining area, and (d) the fourth joining location joins a fourth planar member second joining area and a second planar member second joining area.

9. The folding puzzle to claim 7, wherein (a) the first joining area is located on the third planar member second surface and is bounded by the third planar member first edge, the third planar member second edge, the third planar member first fold line, and an imaginary line extending from substantially the midpoint of third planar member first fold line to substantially the midpoint of the third planar member second edge and the cooperating first joining area is located on the first planar member second surface and is bounded by the first planar member first edge, the first planar member fourth edge, the first planar member second fold line, and an imaginary line extending from substantially the midpoint of first planar member second fold line to substantially the midpoint of the first planar member fourth edge; (b) the second joining area is located on the third planar member second surface and is bounded by the third planar member first edge, the third planar member fourth edge, the third planar member second fold line, and an imaginary line extending from substantially the midpoint of third planar member second fold line to substantially the midpoint of the third planar member fourth edge and the cooperating first joining area is located on the second planar member second surface and is bounded by the second planar member first edge, the second planar member fourth edge, the second planar member second fold line, and an imaginary line extending from substantially the midpoint of second planar member second fold line to substantially the midpoint of the second planar member fourth edge; (c) the first joining area is located on the fourth planar member second surface and is bounded by the fourth planar member first edge, the fourth planar member fourth edge, the fourth planar member first fold line, and an imaginary line extending from substantially the midpoint of fourth planar member first fold line to substantially the midpoint of the fourth planar member fourth edge and the cooperating second joining area is located on the first planar member second surface and is bounded by the first planar member first edge, the first planar member second edge, the first planar member first fold line, and an imaginary line extending from substantially the midpoint of first planar member first fold line to substantially the midpoint of the first planar member fourth edge; and (d) the second joining area is located on the fourth planar member second surface and is bounded by the fourth planar member first edge, the fourth planar member second edge, the fourth planar member second fold line, and an imaginary line extending from substantially the midpoint of fourth planar member second fold line to substantially the midpoint of the fourth planar member second edge and the cooperating second joining area is located on the second planar member second surface and is bounded by the second planar member first edge, the second planar member second edge, the second planar member first fold line, and an imaginary line extending from substantially the midpoint of second planar member first fold line to substantially the midpoint of the second planar member second edge.

10. A folding puzzle comprising a single sheet base having a planar member of predetermined length, width, and square shape further comprising:

a first corner, a second corner, a third corner, and a fourth corner;

a first edge connecting the fourth and first corners;

a second edge connecting the first and second corners;

a third edge connecting the second and third corners;

a fourth edge connecting the third and fourth corners;

a center point of the square planar member;

a first primary midpoint at the midpoint of the first edge;

a second primary midpoint at the midpoint of the second edge;

a third primary midpoint at the midpoint of the third edge;

a fourth primary midpoint at the midpoint of the fourth edge;

a first secondary midpoint at the point along the first edge at the midpoint between the fourth corner and the first primary midpoint;

a second secondary midpoint at the point along the first edge at the midpoint between the first primary midpoint and the first corner;

a third secondary midpoint at the point along the second edge at the midpoint between the first corner and the second primary midpoint;

a fourth secondary midpoint at the point along the second edge at the midpoint between the second primary midpoint and the second corner;

a fifth secondary midpoint at the point along the third edge at the midpoint between the second corner and the third primary midpoint;

a sixth secondary midpoint at the point along the third edge at the midpoint between the third primary midpoint and the third corner;

a seventh secondary midpoint at the point along the fourth edge at the midpoint between the third corner and the fourth primary midpoint;

an eighth secondary midpoint at the point along the fourth edge at the midpoint between the fourth primary midpoint and the fourth corner;

a first tertiary midpoint at the midpoint of a line connecting the first primary midpoint and the second primary midpoint; the a second tertiary midpoint at the midpoint of a line connecting the second primary midpoint and the third primary midpoint;

a third tertiary midpoint at the midpoint of a line connecting the third primary midpoint and the fourth primary midpoint;

a fourth tertiary midpoint at the midpoint of a line connecting the fourth primary midpoint and the first primary midpoint;

a first incision through the square planar member connecting the fourth tertiary midpoint and the center point of the square planar member;

a second incision through the square planar member connecting the first tertiary midpoint and the center point of the square planar member;

a third incision through the square planar member connecting the second tertiary midpoint and the center point of the square planar member;

a fourth incision through the square planar member connecting the third tertiary midpoint and the center point of the square planar member;

a first fold line connecting the first secondary midpoint and the fourth tertiary midpoint;

a second fold line connecting the second secondary midpoint and the first tertiary midpoint;

a third fold line connecting the third secondary midpoint and the first tertiary midpoint;

a fourth fold line connecting the fourth secondary midpoint and the second tertiary midpoint;

a fifth fold line connecting the fifth secondary midpoint and the second tertiary midpoint;

a sixth fold line connecting the sixth secondary midpoint and the third tertiary midpoint;

a seventh fold line connecting the seventh secondary midpoint and the third tertiary midpoint;

an eighth fold line connecting the eighth secondary midpoint and the fourth tertiary midpoint;

a first pivot area having a first side defined by the first edge, a second side defined by the second fold line, a third side defined by the second incision, a fourth side defined by the first incision, and a fifth side defined by the first fold line, the first pivot area additionally having a first surface and a second surface; such that the first pivot area may pivot around the second fold line and the seventh fold line;

a second pivot area having a first side defined by the third fold line, a second side defined by the second edge, a third side defined by the fourth fold line, a fourth side defined by the third incision, and a fifth side defined by the second incision, the second pivot area additionally having a first surface and a second surface; such that the second pivot area may pivot around the first fold line and the fourth fold line;

a third pivot area having a first side defined by the third incision, a second side defined by the fifth fold line, a third side defined by the third edge, a fourth side defined by the sixth fold line, and a fifth side defined by the fourth incision, the third pivot area additionally having a first surface and a second surface; such that the third pivot area may pivot around the third fold line and the sixth fold line;

a fourth pivot area having a first side defined by the eighth fold line, a second side defined by the first incision, a third side defined by the fourth incision, a fourth side defined by the seventh fold line, and a fifth side defined by the fourth edge, the fourth pivot area additionally having a first surface and a second surface; such that the fourth pivot area may pivot around the fifth fold line and the eighth fold line;

a first corner area having a first side defined by the first edge, a second side defined by the second edge, a third side defined by the third fold line and a fourth side defined by the first fold line, the first corner area additionally having a first surface and a second surface;

a second corner area having a first side defined by the fourth fold line, a second side defined by the second edge, a third side defined by the third edge, and a fourth side defined by the fifth fold line, the second corner area additionally having a first surface and a second surface;

a third corner area having a first side defined by the seventh fold line, a second side defined by the sixth fold line, a third side defined by the third edge, and a fourth side defined by the fourth edge, the third corner area additionally having a first surface and a second surface;

a fourth corner area having a first side defined by the first edge, a second side defined by the first fold line, a third side defined by the eighth fold line and a fourth side defined by the fourth edge, the fourth corner area additionally having a first surface and a second surface.

* * * * *